United States Patent [19]

Pollak, Jr. et al.

[11] 4,308,454

[45] Dec. 29, 1981

[54] ACTUATOR FOR POSTAGE METER

[75] Inventors: Philip Pollak, Jr., Westport; Charles M. Weimer, Norwalk, both of Conn.

[73] Assignee: Pitney Bowes Inc., Stamford, Conn.

[21] Appl. No.: 82,193

[22] Filed: Oct. 5, 1979

[51] Int. Cl.[3] ..... G07G 1/00

[52] U.S. Cl. ..... 235/101; 235/1 D

[58] Field of Search ..... 235/1 D, 101; 74/89.15; 221/2; 226/134

[56] References Cited

U.S. PATENT DOCUMENTS 3,664,578 5/1973 Noller ..... 235/101

4,121,473 10/1978 Schubert et al. ..... 74/89.15

*Primary Examiner*—Donald A. Griffin

*Assistant Examiner*—Benjamin R. Fuller

*Attorney, Agent, or Firm*—Donald P. Walker; William D. Soltow, Jr.; Albert W. Scribner

[57] ABSTRACT

An improvement in an actuator adapted to be removably mounted in an operating relationship with respect to a postage meter having a postage value selecting lever positionable in a plurality of positions, one of the positions being a home position. The actuator includes a base having an aperture formed therein through which the postage meter lever extends when the actuator is mounted in the operating relationship with respect to the postage meter. The actuator also includes apparatus for positioning the postage meter lever in the home position for removing the actuator. In addition, the actuator includes means for securing the postage meter lever against inadvertent movement, in particular when an attempt is made to remove the actuator out of the operating relationship with respect to the postage meter prior to returning the postage meter lever to the home position.

15 Claims, 2 Drawing Figures

ACTUATOR FOR POSTAGE METER

BACKGROUND OF THE INVENTION

Postage meter actuators of the type shown in U.S. Pat. No. 4,121,473, issued Oct. 24, 1978 to K. E. Schubert and P. Pollak, Jr. and assigned to the assignee of the present invention, are adapted to be removably mounted in an operating relationship with respect to postage meters; for example, on a postage meter such as a Model 5300 postage meter commercially available from the assignee of the present invention or on a suitable support associated with a Model 5300 postage meter. Such postage meters generally include postage value printing means and a plurality of postage value selecting levers. The postage meter levers are operationally coupled by well-known means to the printing means and individually manually positionable in a plurality of positions for selecting the desired postage value to be printed. The actuator generally includes means for automatically positioning the postage meter levers in response to electrical signals generated for example by means of a data processer associated with an electronic scale in a mailing system of the type discussed in U.S. Pat. No. 4,246,525, issued Jan. 20, 1981 to V. G. Coppola, and assigned to the assignee of the present invention. In such mailing systems the scale includes a pan for weighing mailpieces, and the data processer generates signals which are a function of mailpiece weight, destination and transportation class. Before the actuator is mounted in the operating relationship with respect to the postage meter the postage meter levers must be located in a reference position, such as the zero value position, for synchronizing the actuator, and thus the postage meter, with the remainder of the mailing system, and thus with the zero weight level of the scale pan; for printing postage values which are a function of the weight of successive mailpieces placed on the scale pan. To ensure proper location of the postage meter levers for synchronization purposes, the actuator includes a base wall in the form of a plate having a plurality of elongated apertures formed in the same, through which the postage meter levers must be inserted when the actuator is being mounted on the postage meter. And the apertures are dimensioned to permit insertion of the levers through the base plate only when all of the levers are located in their respective reference positions. With this arrangement, the postage meter levers must be returned by the actuator to their respective reference positions before the actuator can be removed out of the operating relationship with respect to the postage meter, for example to take the postage meter to the local Post Office for resetting purposes. However, it has been found that users often attempt removal of the actuato rs without first returning the postage meter levers to their reference positions; as a result of which the postage meter levers have been inadvertently moved out of synchronism with the associated scale. Accordingly:

An object of the present invention is to provide an actuator for a postage meter having postage value selecting levers, wherein the actuator includes means for preventing inadvertant movement of the postage meter levers, in particular when an attempt is made to move the actuator out of operating relationship with respect to the postage meter prior to returning the levers to a reference or other home position;

Another object is to provide postage meter lever positioning means with means for securing the postage meter levers against inadvertent movement, in particular when the levers are not in their home position and an attempt is made to move the lever positioning means out of operating relationship with respect to the postage meter; and Another object is to provide an actuator, removably mountable in an operating relationship with respect to a postage meter, having a postage value selecting lever positionable in a zero postage value position, with means for blocking lever movement by the actuator when removal of the actuator is attempted prior to returning the lever to its zero postage value position.

SUMMARY OF THE INVENTION

An improvement in an actuator removably mountable in an operating relationship with respect to a postage meter having a postage value selecting lever positionable in a plurality of positions, one of the positions being a home position. The actuator includes a base having an aperture formed therein through which the postage meter lever extends when the actuator is mounted in the operating relationship with respect to the postage meter. The actuator also includes means for positioning the postage meter lever in the home position for removing the actuator. In addition, the actuator includes means for securing the postage meter lever against inadvertant movement, in particular when an attempt is made to remove the actuator prior to returning the postage meter lever to the home position.

BRIEF DESCRIPTION OF THE DRAWINGS

As shown in the drawing wherein like reference numerals designate like or corresponding parts throughout the several figures.

DESCRIPTION OF THE PREFERRED EMBODIMENT

Figure 1:
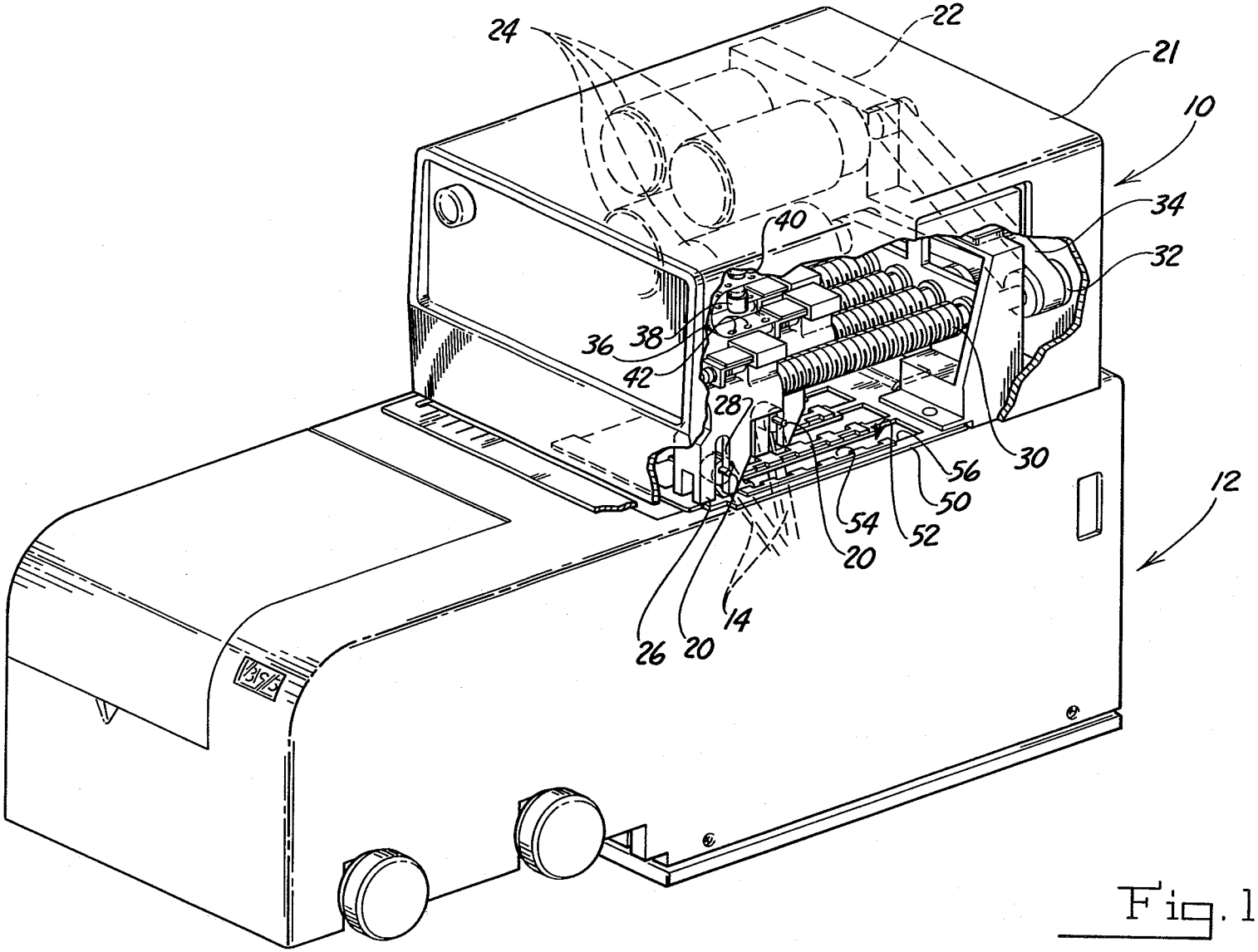
FIG. 1 is a fragmentary perspective view of an actuator according to the invention mounted on a typical postage meter having a plurality of levers which are positionable by the actuator in a plurality of positions, one of which is a reference position.

As shown in FIG. 1, an actuator 10 of the type which may be improved in accordance with the present invention is removably mounted by well-known means in its operating relationship with respect to a postage meter 12, such as a series 5300 Postage Meter commercially available from the assignee of the present invention. The postage meter 12 generally includes well-known means for printing postage (not shown), and includes a plurality of postage value selecting levers 14 (FIG. 2) which are operationally coupled by well-known means to the printing means. The postge meter levers 14 are manually positionable in a plurality of positions 16, corresponding to the values of zero through nine identified by indicia 18 on the postage meter 12, for selecting the desired postage value to be printed. Preferably, each of the levers 14 includes a pin 20 extending in a direction transverse to the direction of movement of the levers 14 to facilitate automatic positioning of the levers 14 by the actuator 10.

Figure 2:
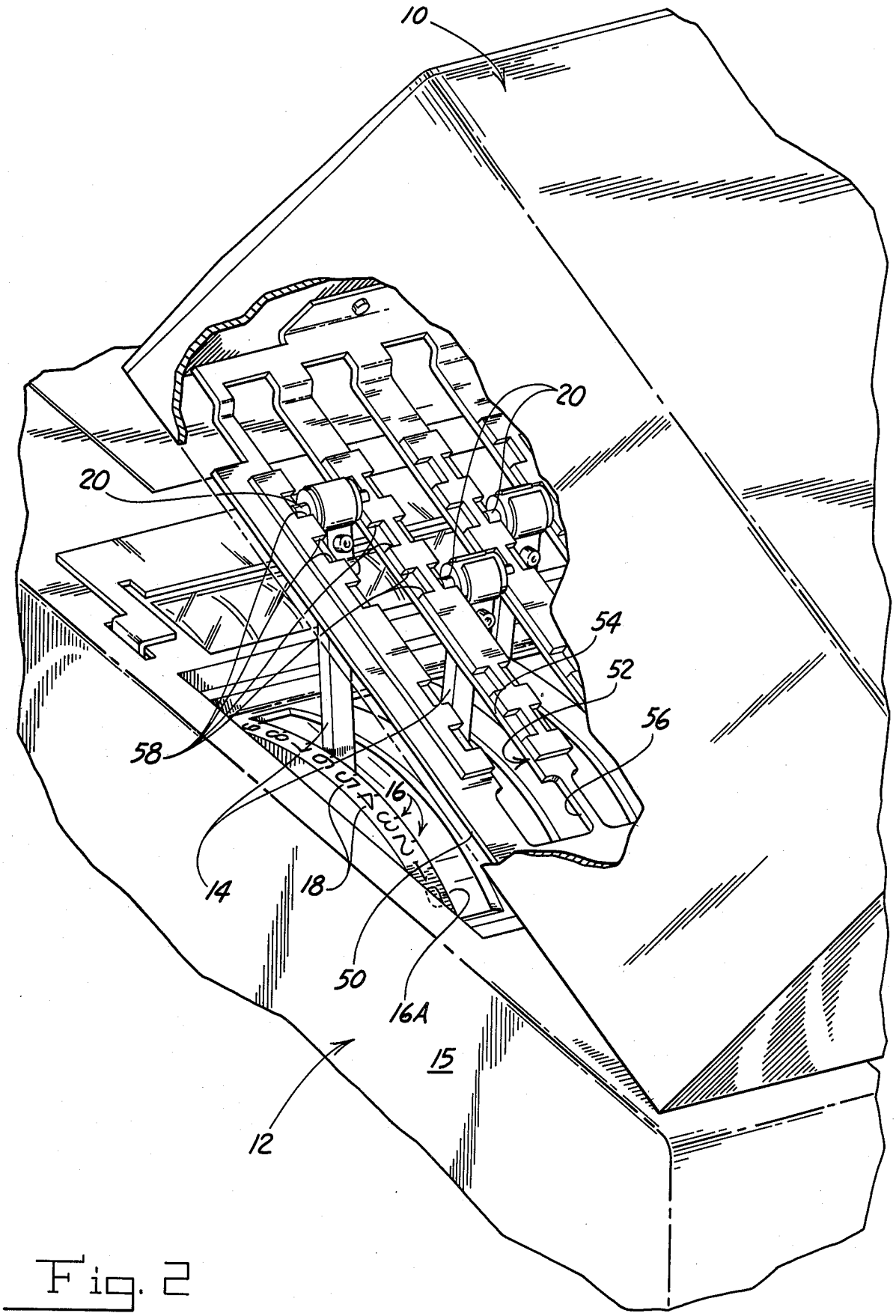
FIG. 2 is an enlarged fragmentary view of the actuator of FIG. 1 showing the manner in which the actuator coacts with the postage meter levers to prevent lever movement when an attempt is made to remove the actuator prior to returning the levers to their respective reference positions.

As discussed in greater detail in the aforesaid U.S. Pat. No. 4,246,525, the subject matter of which is incorporated herein by reference, the actuator 10 (FIG. 1) is adapted by well-known means to be removably mounted in an operating relationship with respect to the postage meter 12, as by means of a housing 21 which is removably attachable to the postage meter 12; and includes conventional framework 22 for supporting the various components of the actuator 10, such components including a plurality of motors 24 for controlling on a one-for-one basis the position of each of the postage meter levers 14. The motors 24 are controlled by signals received from a conventional mailpiece weighting system such as the system discussed in the aforesaid U.S. Pat. No. 4,246,525. For each of the levers 14 the actuator 10 also includes a carrier 26, having a slot 28 formed therein to receive the lever pin 20, a lead screw 30 which threadably engages the carrier 26 for translation thereof, a pulley 32 mounted on the lead screw 30 for rotation thereof and a belt 34 looped about the pulley 32 and connected by well-known means to the motor 24; such that selective rotation of the motor 24 results in selective translation of the associated carrier 26 which, in turn, selectively positions the associated postage meter lever 14 in one of the plurality of the positions 16 (FIG. 2). In addition, for each of the carriers 26 (FIG. 1), the actuator 10 includes suitable means for monitoring the position of the carrier 26, and thus the position of the associated postage meter lever 14; including an encoded tape 36, having one end fixedly attached to the carrier 26. The monitoring means also includes conventional means, such as a light source 38 and photocell 40, for detecting codes 42 on the tape 36 and providing signals indicative of the position of the tape 36 and thus the carrier 28 and associated postage meter lever 14.

According to the invention, the actuator 10 (FIG. 2) includes a base wall 50 in the form of a plate having formed therein a plurality of elongated keyhole-shaped apertures 52. The apertures 52 are dimensioned to permit insertion of the postage meter levers 14 through the base wall 50, for engagement by the carriers 26 (FIG. 1) with which they are respectively associated, when the postage meter levers 14 are located in a home position such as the zero value positions 16A (FIG. 2). To that end, each of the apertures 52 has a elongated channel-shaped portion 54 having a transverse dimension chosen to block the passage of the lever pins 20, and thus the levers 14, through the apertures 52 when the levers 14 are not located in their zero postage value positions 16A. In addition, each of the apertures 52 has a rectangularly shaped portion 56 having a transverse dimension chosen to permit the passage of the lever pins 20, and thus the levers 14, through the base wall 50 when the levers 14 are located in their zero postage value positions 16A. Accordingly, the base wall 50 is constructed and arranged such that when the actuator 10 is being mounted in its operating relationship with respect to the postage meter 12, the postage meter levers 14 must initially be manually moved to their respective zero postage value position 16A, which positions 16A are the reference positions for synchronizing the postage meter 12 with the weighing system associated with the actuator 10.

As shown in FIG. 2 when an attempt is made to remove the actuator 10 out of its operating relationship with respect to the postage meter 12 before the actuator 10 is operated to return the postage meter levers 14 to their zero value positions 16A, the base wall 50 may engage the lever pins 20 and tend to cam the levers 14 toward the zero value positions 16A. To prevent the levers 14 from thereby being inadvertently moved out of synchronism with the associated weighing system, the actuator base wall 50 is constructed and arranged to include means for securing the levers 14 against movement. The lever securing means includes a plurality of ridges 58 which engage the lever pins 20 to block the levers 14 against pivotal movement in either direction by the actuator base wall 50. The ridges 58, which act as stops when they are interposed in the path of travel of the lever pins 20, are preferably located at spaced intervals along the longitudinal length of the base wall 50 such that they obstruct movement of the associated levers 14 out of the postage value selecting positions 16 to which they were last moved by the actuator 10. In addition, a set of ridges 58, including two ridges 58 for engaging a given postage lever pin 20 on opposite sides, is preferably provided to prevent movement of the given lever 14 in either direction out of a given postage value selecting position 16. Further, it is understood that ridges 58 need not be provided in association with all of the lever setting positions 16, inasmuch as the angle between a reference plane extending through the base wall 50 and the plane in which a given lever 14 may be positioned, at the time when an attempt is made to remove the actuator 10 from the meter 12, may be such that the actuator base wall 50 does not exert a force on the given lever 14 which tends to move the lever 14. Accordingly, ridges 58 need only be provided and located for securing a given lever 14 against movement from selected positions 16; the selected positions 16 being limited to those positions 16 in which the base wall 50, when urged into engagement with a given lever 14, exerts a force on the lever 14 which tends to cam the lever 14 toward the nine position 16 or zero postage value reference position 16A.

In accordance with the objects of the invention there has been described an actuator for a postage meter having a postage value selecting lever, wherein the actuator includes means for preventing inadvertant movement of the postage meter lever, in particular when an attempt is made to remove the actuator out of operating relationship with respect to the postage meter prior to returning the lever to a reference or other home position.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In an actuator removably mountable in an operating relationship with respect to a postage meter having a postage value selecting lever positionable in a plurality of positions, one of said positions being a home position, wherein said actuator includes a base having an aperture formed therein through which said postage meter lever extends when said actuator is mounted in the operating relationship with respect to said postage meter, and wherein said actuator includes means for positioning said postage meter lever in said home position for removing said actuator out of the operating relationship with respect to said postage meter, and improvement in the actuator, said improvement comprising:

(a) means adapted to cooperate with said postage meter lever for seucring said postage meter lever against inadvertent movement when an attempt is made to remove said actuator from said postage meter.

2. The improvement according to claim 1, wherein said lever securing means includes means for obstructing lever movement when an attempt is made to remove said actuator prior to returning said postage meter lever to said home position.

3. The improvement according to claim 1, wherein said lever securing means includes means for preventing said base from camming said lever out of at least one of said positions other than said home position.

4. The improvement according to claim 1, wherein said lever securing means includes a stop interposed in the path of travel of the lever when an attempt is made to remove said actuator.

5. The improvement according to claim 2, wherein said lever securing means includes said base, and said base including at least one ridge adapted for engaging said lever when said actuator is being removed and said lever is not disposed in said home position.

6. The improvement according to claim 5, wherein said at least one ridge includes a plurality of ridges located at spaced intervals along the longitudinal length of said base, and each of said ridges located for securing said lever against movement from a selected position thereof other than said home position.

7. Postage meter lever positioning apparatus adapted to be removably mounted in an operating relationship with respect to a postage meter having a lever and a home position therefor, said apparatus comprising:

(a) a base having an aperture formed therein through which the lever may extend, (b) the aperture dimensioned to permit passage of the lever through the base when the lever is in the home position and to block passage of the lever through said base when the lever is not in the home position; and (c) means adaped to cooperate with the lever for preventing inadvertent movement of the lever when the lever is not in the home position and an attempt is made to remove the lever positioning means out of the operating relationship with respect to the postage meter.

8. The apparatus according to claim 7, wherein said lever movement preventing means includes means for securing said lever against movement by said base.

9. The apparatus according to claim 7, wherein said lever movement preventing means includes means for preventing said base from camming said lever when said attempt is made to remove said lever positioning means.

10. The apparatus according to claim 7, wherein said lever movement preventing means includes a stop interposed in the path of travel of the lever when said attempt is made.

11. The apparatus according to claim 8, wherein said lever movement securing means includes said base, and said base including at least one ridge adapted for engaging said lever when said lever positioning means is being removed out of the operating relationship with respect to said postage meter and said lever is not in said home position.

12. The apparatus according to claim 11, wherein said at least one ridge includes a plurality of ridges located at spaced intervals along the longitudinal length of said base, and each of said ridges positioned for securing said lever against movement from a selected position thereof other than said home position.

13. An actuator adapted to be removably mounted in an operating relationship with respect to a postage meter for positioning a postage value selecting lever in a plurality of positions, one of said positions being a zero postage value position, said actuator comprising:

(a) a wall having an aperture formed therein for receiving said postage value selecting lever therethrough when said actuator is being mounted in said operating relationship with respect to said postage meter, said actuator wall adapted for blocking removal of said actuator when said postage value selecting lever is any of said plurality of positions other than said zero postage value position; and (b) means adapted to cooperate with said level for securing said postage value selecting lever against inadvertent movement when removal of said actuator out of said operating relationship with respect to said postage meter is attempted while said postage value selecting lever is not disposed in said zero postage value position.

14. The actuator according to claim 13, wherein said actuator wall includes said means for securing said postage value selecting lever against inadvertent movement, and said securing means including means for obstructing movement of said postage value selecting lever by said actuator wall.

15. The actuator according to claim 14, wherein said lever movement obstructing means includes at least one ridge adapted to stop movement of said postage value selecting lever when said actuator wall is urged into engagement with said postage value selecting lever so as to exert a force thereon tending to cam said postage value selecting lever out of at least one of said plurality of positions other than said zero postage value position.

* * * * *